US006227411B1

(12) United States Patent
Good

(10) Patent No.: US 6,227,411 B1
(45) Date of Patent: May 8, 2001

(54) FLUID DISPENSER WITH CHILD-RESISTANT NOZZLE ASSEMBLY

(75) Inventor: Robert J. Good, Raytown, MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/373,503

(22) Filed: Aug. 13, 1999

(51) Int. Cl.[7] ..... B67D 5/42

(52) U.S. Cl. ..... 222/153.13; 222/153.14; 222/380; 215/220

(58) Field of Search ..... 215/220; 222/153.13, 222/153.14, 380, 48; 239/333

(56) References Cited

U.S. PATENT DOCUMENTS

| | | | | |
|---|---|---|---|---|
| 2,847,139 | * | 8/1958 | Christiansson et al. | 215/220 |
| 3,650,473 | * | 3/1972 | Malone | 239/333 |
| 3,782,604 | * | 1/1974 | Kelssler | 222/153.14 |
| 4,069,935 | * | 1/1978 | Hampel | 215/220 X |
| 4,204,614 | * | 5/1980 | Reeve | 222/153.14 |
| 4,257,561 | * | 3/1981 | McKinney | 222/153.14 X |
| 4,402,416 | * | 9/1983 | Mumford et al. | 215/220 |
| 4,705,181 | * | 11/1987 | Burke et al. | 215/220 |
| 4,706,888 | | 11/1987 | Dobbs | 222/380 X |
| 5,050,779 | * | 9/1991 | Knickerbocker | 222/153.14 |
| 5,088,628 | | 2/1992 | Knickerbocker | 222/380 X |
| 5,267,692 | * | 12/1993 | Maas et al. | 239/333 |
| 5,335,858 | * | 8/1994 | Dunning et al. | 239/333 |
| 5,647,539 | | 7/1997 | Dobbs et al. | 222/380 X |
| 5,848,733 | * | 12/1998 | Foster et al. | 222/153.13 |

* cited by examiner

*Primary Examiner*—Kenneth Bomberg
(74) *Attorney, Agent, or Firm*—Dykema Gossett PLLC

(57) ABSTRACT

A dispenser body supports a nozzle cap for rotation about a longitudinal axis thereof between ON and OFF positions. A nozzle cover surrounds the nozzle cap, is freely rotatable about the nozzle cap and is movable along the longitudinal axis relative to the nozzle cap, to render the same child resistant. Engaging portion on the nozzle cap and the nozzle cover are longitudinally spaced apart in a first longitudinal position to prevent rotation of the nozzle cap by rotating the nozzle cover, thereby preventing the nozzle cap from being rotated from one position to another. In a second longitudinal position of the nozzle cover relative to the nozzle cap, the engaging portions interengage to enable the nozzle cap to be rotated by the nozzle cover to enable the nozzle cap to be rotated from one position to another.

15 Claims, 3 Drawing Sheets

FLUID DISPENSER WITH CHILD-RESISTANT NOZZLE ASSEMBLY

BACKGROUND OF THE INVENTION

The present invention relates to a manually operated fluid dispenser having a child-resistant nozzle assembly, the dispenser having a dispenser body supporting a nozzle cap for rotation about the longitudinal axis thereof between various ON and OFF positions. The nozzle assembly is designed to prevent children from rotating the cap to its ON position for dispensing fluid therefrom.

It is desirable to provide a construction wherein the nozzle cap cannot be moved from one of its OFF positions to one of its ON positions by a child, but which can be readily so moved by an adult. This end result can be accomplished by providing an arrangement wherein a person is required to sequentially perform at least two different manual functions such as moving a member longitudinally and then rotating the member through a significant angle of rotation. This is very difficult for a child to accomplish, but is a procedure which can easily be performed by an adult.

It is particularly important that a child-resistant nozzle assembly be provided when dispensing various fluids such as household fluids which may be toxic or otherwise harmful if swallowed or if sprayed on the person's skin. It is accordingly a principle object of the invention to provide a nozzle assembly which is relatively simple and inexpensive in construction, yet which is effective in preventing accidental operation of the dispenser by a child.

SUMMARY OF THE INVENTION

The present invention includes a dispenser body which supports a nozzle cap for rotation about the longitudinal axis thereof between ON and OFF positions of the nozzle cap. A nozzle cover is disposed in surrounding relationship to the nozzle cap and is rotatable about the cap axis. The nozzle cover is also movable along the longitudinal axis relative to the nozzle cap. The nozzle cap and the nozzle cover have engaging portions thereon which are longitudinally spaced apart in a first longitudinal position of the nozzle cover relative to the nozzle cap. In this first longitudinal position, the nozzle cover can freely rotate around the nozzle cap, and no rotational movement will be imparted to the nozzle cap. Furthermore, the nozzle cover is disposed in surrounding overlying relationship to the outer surface of the nozzle cap so that a child cannot gain access to the nozzle cap and turn it from an OFF position to an ON position.

When an adult wishes to dispense fluid from the dispenser, the adult manually grasps the nozzle cover and moves it longitudinally relative to the nozzle cap to a second longitudinal position where engaging portions on the nozzle cover come into contact with engaging portions on the nozzle cap. While holding the nozzle cap in this second longitudinal position with sufficient force to overcome sliding, the adult can rotate the nozzle cover and the nozzle cap about the longitudinal axis of the nozzle cap, thereby moving the nozzle cap from an OFF position to an ON position.

When it is desired to move the nozzle cap back to an OFF position, the nozzle cover can again be rotated with the engaging portions in contact with one another to cause the nozzle cap to be rotated to an OFF position. The adult can then move the nozzle cover longitudinally of the nozzle cap to the first longitudinal position where the engaging portions are spaced from one another, and the nozzle cover can be left in this longitudinal position. If a child then rotates the nozzle cover, it will freely rotate relative to the nozzle cap, and the nozzle cap will remain in its OFF position.

DESCRIPTION OF THE PREFERRED EMBODIMENT

Figure 1:
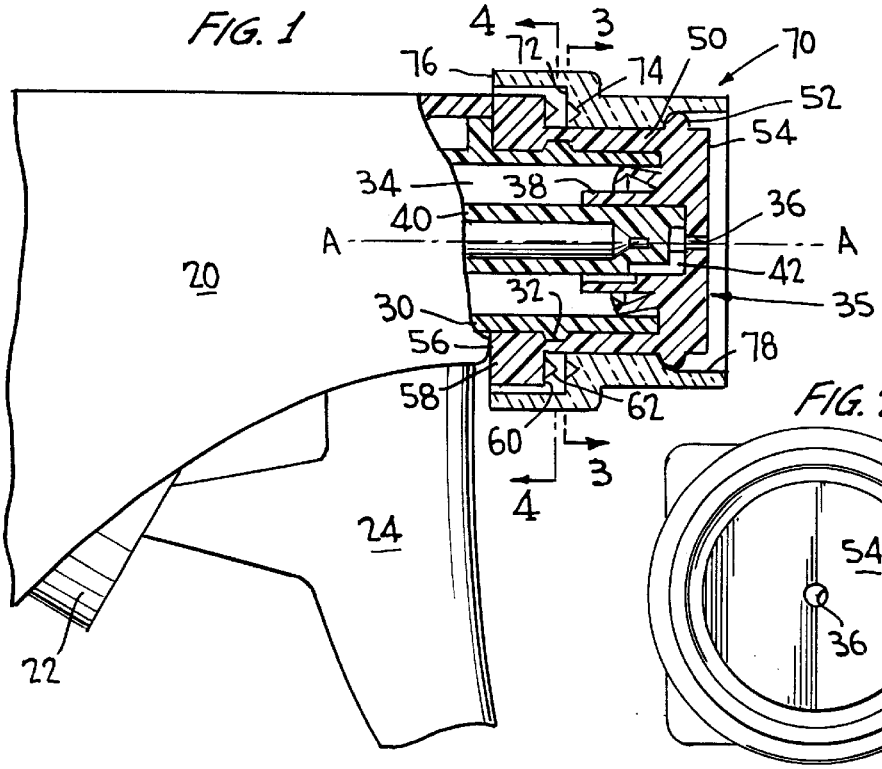
FIG. 1 is a side view of one end of a fluid dispenser cut away and showing in section the outer portion of the pump body with the nozzle cap and nozzle cover rotatably supported thereon.
Figure 2:
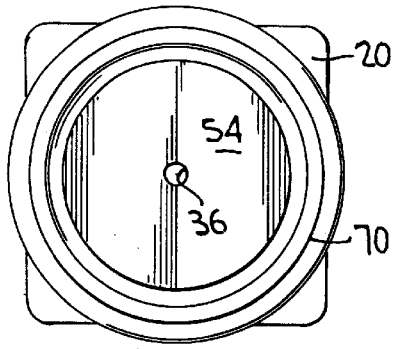
FIG. 2 is an end view of the structure shown in FIG. 1.

Referring now to the drawings wherein like reference characters designate corresponding parts throughout the several views, there is shown in FIGS. 1–5 a first embodiment of the invention wherein a conventional dispenser or pump body is provided with an outer shroud 20. The pump body has the usual pump cylinder 22 containing a reciprocable pump piston (not shown) which is manually reciprocated by a trigger actuator 24 hingedly mounted on the pump body. It is apparent that the invention can also be utilized with a dispenser which does not have a shroud.

The pump body portion has a generally cylindrical nozzle portion 30 at its downstream end including an outwardly projecting annular rib 32 formed thereon. A conventional discharge passage 34 is defined within nozzle portion 30. A plastic nozzle cap 35 has a discharge orifice 36 formed therethrough, the nozzle cap including a sleeve portion 38 which is rotatably supported on a plug element 40 of the pump body. Conventional valving 42 is provided within sleeve 38 such as shown in U.S. Pat. No. 4,706,888, commonly owned herewith.

Nozzle cap 35 has a generally cylindrical portion 50 which is supported on the outer surface of nozzle portion 30 for rotation about longitudinal axis A—A of the nozzle cap. The inner surface of portion 50 of the nozzle cap has an annular groove formed therein which receives rib 32 on nozzle portion 30 for holding the nozzle cap in place longitudinally of portion 30, but permitting rotation of the nozzle cap with respect to nozzle portion 30. The nozzle cap has an annular snap bead 52 formed thereon adjacent outer end 54 of the nozzle cap for a purpose hereinafter described. At the inner end 56 of the nozzle cap, an annular radially extending flange 58 is provided having a downstream annular face 60 from which extend a plurality of spaced engaging portions in the form of projections 62.

Figure 5:
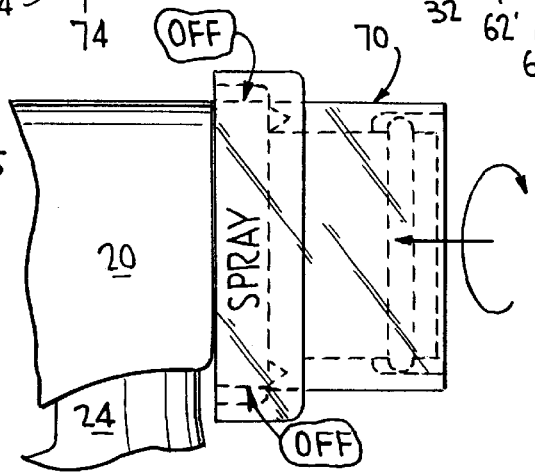
FIG. 5 is a side view of the discharge end of the dispenser shown in FIG. 1 with the nozzle cover in a different longitudinal position.

A plastic nozzle cover 70 has an inner generally cylindrical surface which is supported on the complementary outer surface of portion 50 of the nozzle cap for rotation about axis A—A relative to the nozzle cap. The nozzle cover is also mounted for longitudinal movement along the outer surface of portion 50 of the nozzle cap between a first position relative to the nozzle cap as shown in FIG. 1 and a second position relative to the nozzle cap as shown in FIG. 5.

Figure 3:
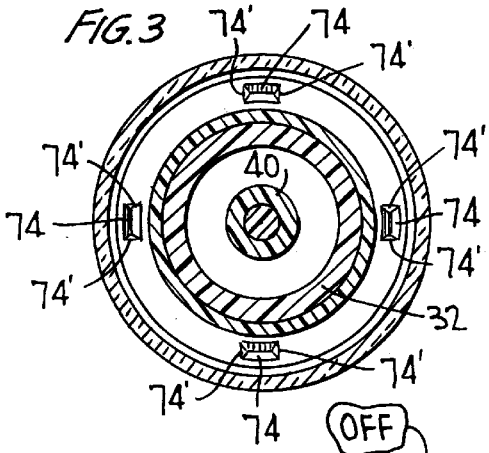
FIG. 3 is a cross-sectional view taken along line 3—3 of FIG. 1.
Figure 4:
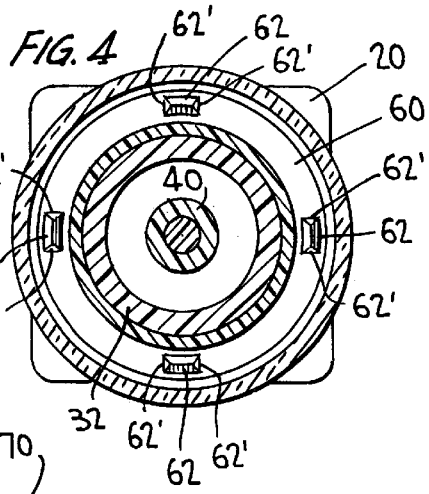
FIG. 4, is a cross-sectional view taken along line 4—4 of FIG. 1.

Nozzle cover 70 has an annular face 72 thereon which confronts annular face 60 on the nozzle cap. A plurality of recesses 74 are formed in face 72 which define engaging portions for engaging projections 62 on the nozzle cap. As seen in FIG. 4, engaging portions 62 have opposite side surfaces 62' which slope at an angle of greater than ninety degrees with respect to face 60 so that projections 62 taper from surface 60 to a smaller dimension at the outer ends thereof. As seen in FIG. 3, engaging portions 74 have opposite side surfaces 74' which slope at an angle of greater than ninety degrees with respect to face 72 so that recesses 74 taper from the surface 72 to a smaller dimension at the inner ends of the recesses.

The side surfaces 62' and 74' engage one another when nozzle cover 70 is rotated in either direction. The angle of the side surfaces determines the amount of force that must be applied longitudinally to the nozzle cover in order to rotate the nozzle cap when the nozzle cover is rotated. The greater the angle, the more force is required. It is apparent that the engaging portions may have many different configurations.

Nozzle cover 70 also includes a longitudinally extending annular flange 76 which as seen in FIG. 1 is disposed in overlying relationship to the outer surface of flange 58 of the nozzle cap so that when the nozzle cover is in the position shown in FIG. 1, a child does not have access to the outer surface of the nozzle cap and cannot directly rotate the nozzle cap. Additionally, when in the position shown in FIG. 1, the engaging portions 62 on the nozzle cap and 74 on the nozzle cover are spaced from one another in a longitudinal direction, so that the nozzle cover can freely rotate relative to the nozzle cap. Therefore, any rotation of the nozzle cover will not result in corresponding rotation of the nozzle cap.

In the position of the nozzle assembly including the nozzle cap and the nozzle cover shown in FIG. 1, the nozzle cap is in one of its OFF positions, and the nozzle cap cannot be rotated without moving the nozzle cover longitudinally toward the pump body into (upstream direction) the position where the engaging portions on the nozzle cover and the nozzle cap are in contact with one another as shown in FIG. 5. The nozzle cover can then be rotated in either direction to cause the nozzle cap to rotate into one of its ON positions.

The outer surface of flange 58 of the nozzle cap is provided with indicia to indicate the position of the nozzle cap so as to produce a particular mode of operation of the dispenser when looking down at the top of the dispenser. As shown in FIG. 5, the nozzle cap is in one of its OFF positions. Rotation of the nozzle cap through an angle of 90 degrees in either direction will cause the nozzle cap to move into a SPRAY or STREAM position in a well-known manner. The nozzle cover is formed of transparent or translucent plastic material so that the indicia may be viewed through the cover. The inner surface at the outer end of the nozzle cover is provided with a cutout 78 which enables the nozzle cover to be snapped into place over snap bead 52.

Figure 6:
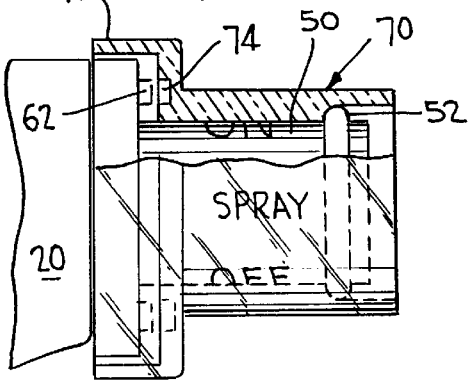
FIG. 6 is a side view partly broken away and partly in section showing a modified form of the invention.
Figure 7:
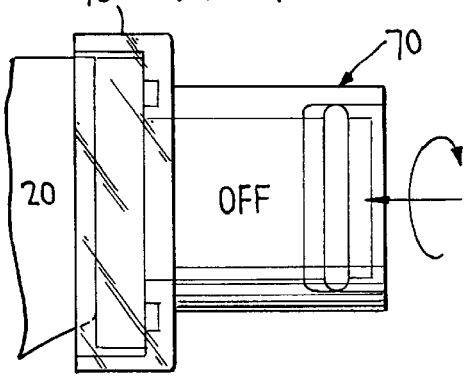
FIG. 7 is a side view of the discharge end of the dispenser shown in FIG. 6 with the nozzle cover in a different longitudinal position.

Referring to FIGS. 6 and 7, the structure is substantially the same as shown in FIGS. 1–5, and accordingly, the components of FIGS. 6 and 7 have been given the same reference numerals as used in FIGS. 1–5. The only difference in the modification shown in FIGS. 6 and 7 is that the indicia such as SPRAY and OFF are provided on the outer surface of portion 50 of the nozzle cap. In the longitudinal position of the nozzle cover shown in FIG. 6, the engaging portions are spaced from one another, while in the longitudinal position of the nozzle cover shown in FIG. 7, the engaging portions are in contact with one another and the nozzle cap has been rotated ninety degrees by rotating the nozzle cover.

Figure 8:
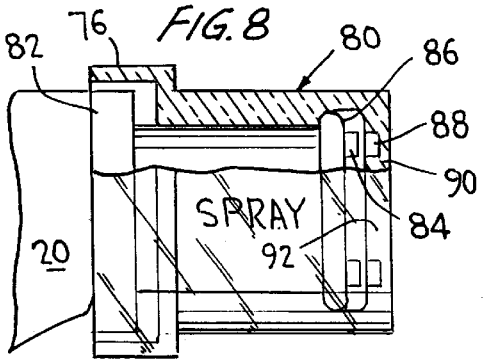
FIG. 8 is a side view partly broken away and partly in section showing another modified form of the invention.
Figure 9:
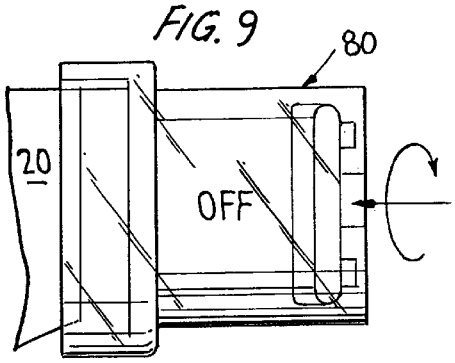
FIG. 9 is a side view of the discharge end of the dispenser shown in FIG. 8 with the nozzle cover in a different longitudinal position.

Referring to FIGS. 8 and 9, a modification is disclosed wherein the nozzle cover 80 and the nozzle cap 82 are of substantially the same construction as the corresponding components shown in FIGS. 1–5 with the exception that the engaging portions are disposed at different locations. The projections 84 extend from the outer end 86 of the nozzle cap, while the recesses 88 are formed in the inner face of an end wall 90 of the nozzle cover. Wall 90 has a central opening 92 through which passes fluid discharged through the discharge orifice of the nozzle cap. The nozzle cover is formed of transparent or translucent material so that indicia on the outer surface of the nozzle cap can be viewed. In the longitudinal position of the nozzle cover shown in FIG. 8, the engaging portions are spaced from one another in a longitudinal direction so that rotation of the nozzle cover will not cause rotation of the nozzle cap. In the longitudinal position of the nozzle cover shown in FIG. 9, the engaging portions interengage and the nozzle cap has been rotated by rotating the nozzle cover. As in the foreign embodiments, the nozzle cover is formed of transparent or translucent plastic material.

Figure 10:
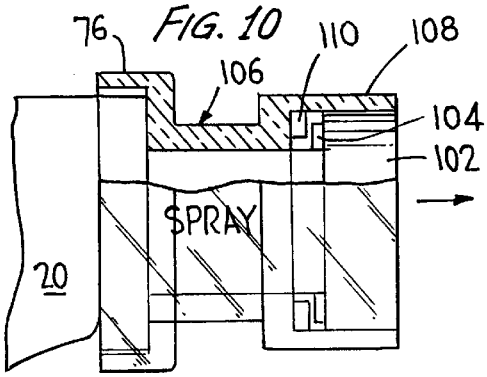
FIG. 10 is a side view partly broken away and partly in section showing a further modified form of the invention.
Figure 11:
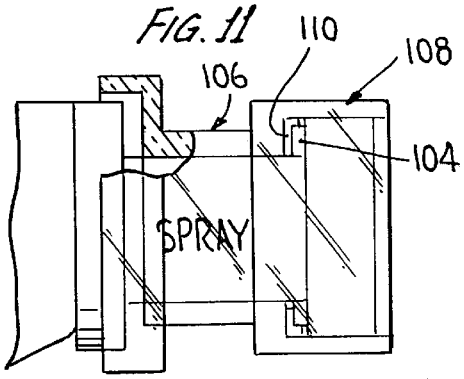
FIG. 11 is a side view of the discharge end of the dispenser shown in FIG. 10 with the nozzle cover in a different longitudinal position.

Referring to FIGS. 10 and 11, a modified nozzle cap 100 is similar to that shown in FIGS. 1–5, but an annular radially outwardly extending portion 102 is provided on the outer end of the nozzle cap. A plurality of engaging portions 104 are formed as projections similar to those previously described. A nozzle cover 106 is provided with an enlarged outer end portion 108 within which are disposed engaging portions 110 in the form of similar projections which are adapted to engage projections 104. In the longitudinal position of the nozzle cover shown in FIG. 10, the engaging portions are spaced from one another in a longitudinal direction so that the nozzle cap cannot be rotated. In the longitudinal position of the nozzle cover shown in FIG. 11, the engaging portions are in contact with one another so that the nozzle cap can be rotated by rotating the nozzle cover. It is noted that in this form of the invention, the nozzle cover is moved away from the pump body to cause the engaging portions to interengage, whereas in the previous modifications, the nozzle cover is moved toward the pump body to cause the engaging portions to contact one another. The nozzle cover 106 is formed of transparent or translucent material.

Figure 12:
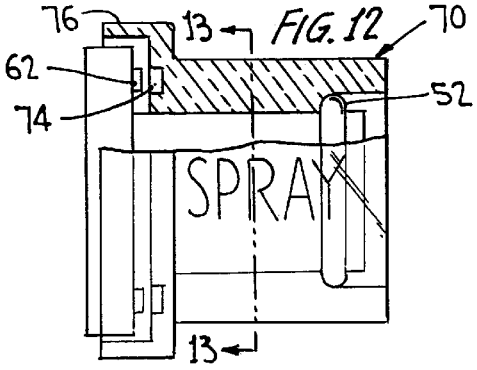
FIG. 12 is a side view partly broken away and partly in section showing a still further modified form of the invention.
Figure 13:
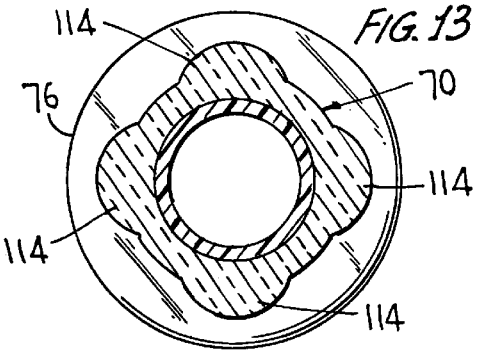
FIG. 13 is a cross-section taken on line 13—13 of FIG. 12.

Referring to FIGS. 12 and 13, a modified construction is similar to that shown in FIGS. 6 and 7, and similar parts have been given the same reference numerals. The nozzle cover in this form of the invention has a novel cross-sectional configuration as seen in FIG. 13 wherein the transparent or translucent nozzle cover 70 is provided with four spaced outwardly projecting concave portions 114 to effectively serve as optical lenses which magnify the indicia disposed around the outer surface of the nozzle cap. It is noted that the four portions 114 are spaced ninety degrees from one another as are the indicia of the nozzle cap. Accordingly, the lenses enhance viewing of the indicia, as indicated by the size of the word SPRAY as shown in FIG. 12.

Figure 14:
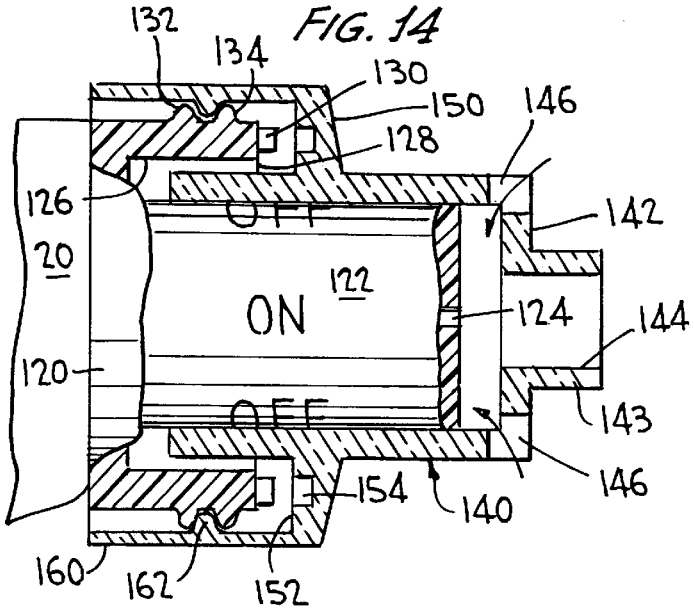
FIG. 14 is a side view of yet another modified form of the invention with one end of a fluid dispenser cut away and showing in section the nozzle cap and nozzle cover rotatably supported on the pump body.
Figure 15:
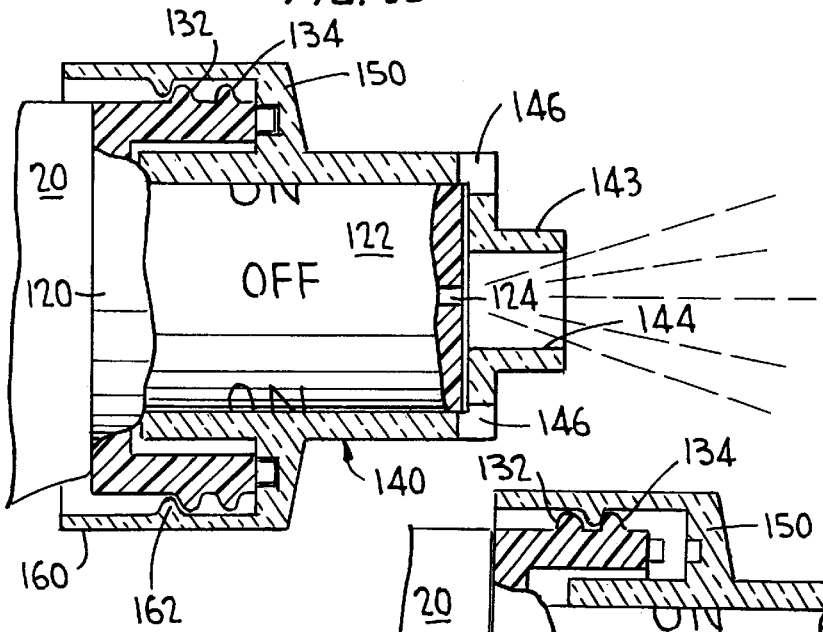
FIG. 15 is a view similar to FIG. 14 showing the components in a different operative position.
Figure 16:
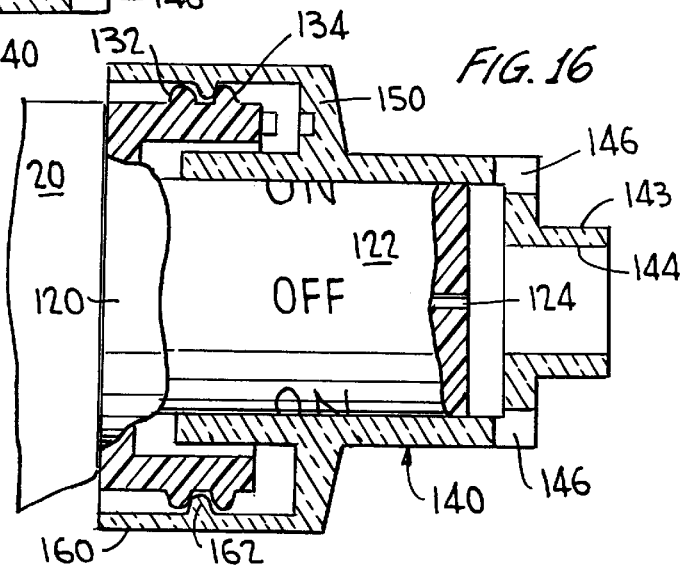
FIG. 16 is a view similar to FIG. 14 showing the components in still another different operative position.

Referring to FIGS. 14–16 of the drawings, a further modification is illustrated. A plastic nozzle cap 120 includes a generally cylindrical portion 122 corresponding to portion 50 shown in FIG. 1. Portion 122 has indica disposed on the outer surface thereof, and the outer end of the nozzle cap is provided with a discharge orifice 124. The inner end of the nozzle cap is provided with an annular flange 126 which extends outwardly in concentric relationship to portion 122 of the nozzle cap. The outer end of flange 126 defines an annular surface 128 having engaging portions 130 in the form of projections similar to engaging portions 62 previously described disposed at four spaced locations about the surface 128 in a similar manner in which projections 62 are disposed about surface 60 as seen in FIG. 4. The outer surface of flange 126 has formed thereon two spaced annular snap beads 132 and 134 for a purpose hereinafter described.

A nozzle cover 140 is mounted on the outer surface of portion 122 of the nozzle cap for rotation relative to the nozzle cap and also for longitudinal movement of the nozzle cover with respect to the nozzle cap. The nozzle cover includes a front wall 142 which joins with a cylindrical portion 143 defining a discharge opening 144 aligned with discharge orifice 124 of the nozzle cap. A plurality of circumferentially spaced air aspiration openings 146 are provided in the outer part of the nozzle cover for ingesting air to mix with the product sprayed through orifice 124 to thereby effect a foam discharge from the nozzle assembly in a spray ON position of the device as turbulence is created within a chamber defined by the wall of opening 144. See U.S. Pat. No. 5,647,539 commonly owned herewith.

The nozzle cover also includes a radially outwardly extending flange 150 defining an annular surface 152 having formed therein a plurality of spaced recesses 154, the configuration and spacing of which is similar to that of recesses 74 in surface 72 as seen in FIG. 3. Recesses 154 cooperate with the projections 130 to provide engaging portions which are longitudinally spaced from one another in the first longitudinal position of nozzle cover 140 as seen in FIG. 14.

Nozzle cover 140 also includes a longitudinally extending flange 160 extending in overlying relationship to flange 126 of the nozzle cap. Flange 160 has a snap bead 162 formed on the inner surface thereof, snap bead 162 being disposed between snap beads 132 and 134 as shown in FIG. 14 to provide a retaining means for holding the nozzle cover in a given longitudinal position relative to the nozzle cap. In this position, the engaging portions 130 and 154 are disposed in spaced relationship to one another. This is the child resistant position such that a child cannot gain access of the outer surface of flange 126 of the nozzle cap, and any rotation of the nozzle cover will not cause rotation of the nozzle cap. In this position, the nozzle cover can freely rotate relative to the nozzle cap about its central axis.

When it is desired to rotate the nozzle cap to one of its ON positions, the engaging portions must be aligned with one another, and the nozzle cover must be pushed toward the pump body to cause snap bead 162 to jump over snap bead 132 to bring the engaging portions into contact with one another. The nozzle cap can then be rotated into the ON position shown in FIG. 15 wherein the nozzle assembly operates in a spray mode. If it is desired to operate the nozzle assembly in a foam mode, the nozzle cover can be pulled straight out to cause snap bead 162 to jump over snap bead 132 so that the components are disposed in the position shown in FIG. 16. Upon trigger actuation, the conical spray issuing through orifice 124 impacts against the wall of opening 144 thereby creating and concentrating a foam as the spray particles mix with air as aspirated through openings 146.

If it is then desired to return the nozzle cap to an OFF position, The nozzle cover is then moved back into the position shown in FIG. 15, whereupon the nozzle cap can be rotated back into the position shown in FIG. 14 so that the nozzle assembly is again child resistant.

The present invention has been described with reference to a nozzle cap snap fitted to nozzle portion 30 of the dispenser body for rotation between ON and OFF positions without axial displacement, although other type nozzle caps can be rendered child-resistant without departing from the scope of the invention. For example, the nozzle cap can otherwise be internally threaded for engagement with external threads on nozzle portion 30 such that the cap is axially displaced upon rotation between ON and OFF positions. Such a threaded cap is well known in this art and therefore need not be detailed here.

Obviously, many modifications and variations of the present invention are made possible in the light of the above teachings. It is therefore to be understood that within the scope of the appended claims the invention may be practiced otherwise than as specifically described.

What is claimed is:

1. A fluid dispenser including a dispenser body, a child-resistant nozzle assembly comprising a nozzle cap having a longitudinal axis and being supported on said body against axial movement along said axis and for rotation about said longitudinal axis between ON and OFF positions of said nozzle cap, a nozzle cover disposed in surrounding relationship to said nozzle cap and being rotatable about said longitudinal axis with respect to said nozzle cap, said nozzle cover also being movable along said longitudinal axis relative to said nozzle cap, said nozzle cap and said nozzle cover having engaging portions thereon which are longitudinally spaced apart in a first longitudinal position of said nozzle cover relative to said nozzle cap to prevent rotation of said nozzle cap by rotation of said nozzle cover, said engaging portions engaging one another in a second longitudinal position of said nozzle cover relative to said nozzle cap to enable rotation of said nozzle cap by rotation of said nozzle cover.

2. A dispenser as defined in claim 1, wherein said nozzle cap is provided with a first annular surface and said nozzle cover is provided with a second annular surface, said annular surfaces confronting one another, one of said annular surfaces having projections formed thereon, and the other of said annular surfaces having recesses formed thereon for receiving said projections.

3. A dispenser as defined in claim 2, wherein said projections and said recesses have engageable surfaces formed thereon, one of said projections and said recesses sloping at an angle with respect to said annular surfaces.

4. A dispenser as defined in claim 1, wherein said nozzle cover is moved away from said body when the nozzle cover is moved into said first position and is moved toward said body when the nozzle cover is moved into said second position.

5. A dispenser as defined in claim 4, wherein said nozzle cap includes an inner end portion and an outer end portion, the engaging portions on said nozzle cap being disposed adjacent said inner end portion of the nozzle cap.

6. A dispenser as defined in claim 4, wherein said nozzle cap includes an inner end portion and an outer end portion, the engaging portions of said nozzle cap being disposed adjacent said outer end portion of the nozzle cap.

7. A dispenser as defined in claim 1, wherein said nozzle cover is moved toward said body when the nozzle cover is moved into said first position and is moved away from said body when the nozzle cover is moved into said second position.

8. A dispenser as defined in claim 7, wherein said nozzle cap includes an inner end portion, an outer end portion and an intermediate portion therebetween, the engaging portions of said nozzle cap being disposed at said intermediate portion of the nozzle.

9. A dispenser as defined in claim 1, wherein said nozzle cap includes an outer surface having indicia formed thereon, said nozzle cover being formed of transparent or translucent material so that the indicia may be readily viewed in any position of the nozzle cover.

10. A dispenser as defined in claim 9, wherein said nozzle cover includes a plurality of lens portions for magnifying said indicia to enhance viewing thereof.

11. A dispenser as defined in claim 1, including retaining means formed on said nozzle cap and said nozzle cover for retaining said nozzle cover in said first and second longitudinal positions of said nozzle cover.

12. A dispenser as defined in claim 11, wherein said nozzle cover has air aspiration openings formed therethrough for introducing air into the nozzle cover for creating a foam discharge when the dispenser is actuated.

13. A dispenser as defined in claim 12, wherein said retaining means is adapted to retain said nozzle cover in said first position after said nozzle has been rotated by said nozzle cover to provide a foam discharge when the dispenser is actuated.

14. A dispenser as defined in claim 11, wherein said retaining means is adapted to retain said nozzle cover in said second position after said nozzle has been rotated by said nozzle cover to provide a spray discharge when the dispenser is actuated.

15. A dispenser as defined in claim 11, wherein said retaining means comprises cooperating interengaging snap beads formed on said nozzle cap and said nozzle cover.

* * * * *